US006024237A

United States Patent [19]

Burgdorf et al.

[11] Patent Number: 6,024,237

[45] Date of Patent: Feb. 15, 2000

[54] PALLET CONTAINER

[75] Inventors: Märten Burgdorf, Heimerzhiem; Dietmar Przytulla, Kerpen, both of Germany

[73] Assignee: Mauser-Werke GmbH, Germany

[21] Appl. No.: 08/129,108

[22] PCT Filed: Feb. 6, 1993

[86] PCT No.: PCT/EP93/00284

§ 371 Date: Nov. 18, 1993

§ 102(e) Date: Nov. 18, 1993

[87] PCT Pub. No.: WO93/15966

PCT Pub. Date: Aug. 19, 1993

[30] Foreign Application Priority Data

Feb. 18, 1992 [DE] Germany ..... 92 02 045 U

[51] Int. Cl.[7] ..... B65D 90/04

[52] U.S. Cl. ..... 220/23.91; 220/23.87; 220/668; 220/1.5

[58] Field of Search ..... 220/403, 401, 220/495, 494, 402, 400, 1.5, 4.16, 4.17, 4.33, 4.28, 630, 622, 668, 23.91, 23.87, 23.83, 23.86; 206/386, 600

[56] References Cited

U.S. PATENT DOCUMENTS

| | | | |
|---|---|---|---|
| 820,306 | 5/1906 | Holle | 220/401 |
| 1,237,093 | 8/1917 | Priddy | 220/401 |
| 3,792,796 | 2/1974 | Woodruff et al. | 220/495 |
| 3,979,006 | 9/1976 | Jurasek . | |
| 4,054,223 | 10/1977 | Marques | 220/403 |
| 4,676,373 | 6/1987 | Schneider | 220/401 |
| 4,909,387 | 3/1990 | Schutz | 220/401 |
| 4,921,196 | 5/1990 | Rudko | 220/401 |
| 4,947,988 | 8/1990 | Schutz | 220/401 |
| 5,058,747 | 10/1991 | Decroix et al. . | |
| 5,110,000 | 5/1992 | Nichols . | |

FOREIGN PATENT DOCUMENTS

| | | | |
|---|---|---|---|
| 154550 | 1/1953 | Australia | 206/600 |
| 0 438 718 A | 7/1991 | European Pat. Off. . | |
| 2 275 372 | 2/1976 | France . | |
| 2643043 | 8/1990 | France | 206/600 |
| 30 39 635 | 7/1981 | Germany . | |
| 647192 | 2/1979 | U.S.S.R. | 206/600 |
| 1 514 021 | of 0000 | United Kingdom . | |
| 91/18806 | 12/1991 | WIPO . | |

*Primary Examiner*—Stephen Castellano
*Attorney, Agent, or Firm*—Pennie & Edmonds LLP

[57] ABSTRACT

A pallet container (10) has a thin-walled plastic container (12), a support casing (14) made of a wire grating and a bottom pallet (16). In order to improve the falling resistance of such a pallet container (10), some of the vertical rods (18) that form the wire grating of the support casing (14) are prolonged, extend through bores (20) provided in the bottom pallet (16) and are screwed from below against the bottom pallet by a screw nut (28).

16 Claims, 4 Drawing Sheets

PALLET CONTAINER

BACKGROUND OF THE INVENTION

The invention relates to a pallet container having a thin-walled plastic container for liquid or flowable substances, including a steel-mesh cage of horizontal and vertical rods tightly enclosing the plastic container, thus forming a support cage, and a floor pallet on which the plastic container is seated and to which the steel-mesh support cage is permanently attached.

A pallet container of this type, having a steel-mesh support cage for the inner, thin-walled plastic container is known from DE-B-30 39 635. The steel-mesh support cage is fastened to the floor pallet—a commercial pallet of wood, for example—by means of cramps, clamps or claws across the very bottom horizontal rod. The cramps or clamps may be nailed (riveted) or screwed to the top plate of the pallet.

Another pallet container that is well-known (EP-A-0 438 718) has the individual pallet elements of wood connected by flat steel elements across them at an suitable distance above them (for the use of the lifting forks of a forklift vehicle). The support cage, its very bottom includes a horizontal rod which is fastened to the floor pallet by means of sheet steel brackets welded to the flat steel elements.

The pallet containers must pass official approval procedures meeting certain quality criteria so that they can be used in industry. For example, internal pressure testing and drop testing from specific drop heights with the pallet containers filled are carried out. The most unfavourable case is a diagonal drop to the lower pallet face, where the bottom discharge valve of the inner plastic containers is located.

Drop testing of this type showed that the inner container, when it hits the ground, will attempt to shift against the floor pallet due to the kinetic energy; at the same time, the fastening brackets of the cage shell are torn off the floor pallet in other areas of the circumference also. Therefore, the fastening of the lower edge of the steel-mesh support cage to the pallet is a significant weak point. As the steel-mesh support cage is fixed only at a few points, the steel mesh is deformed and distorted very unevenly; part of the weldment joints at the mesh intersections will tear apart, and free rod ends may damage the thin-walled plastic container.

SUMMARY OF THE INVENTION

It is the objective of the present invention to eliminate the disadvantages of the prior constructions as described above and to provide a pallet container where improved fixing of steel mesh cage and plastic container to the floor pallet is given by simple means, and where higher drop heights are ensured showing a more uniform or reduced deformation of the steel mesh cage and floor pallet without damage to (leakage of) the inner container.

The present invention solves this problem by having, at each face of the floor pallet, at least one vertical rod of the steel-mesh support cage extended on each face of the floor pallet, the rod passing through a corresponding bore in the floor pallet, at least through the top plate, or through the top plate and the bottom plate of the floor pallet and being fitted with a heel on the underside of the top plate and the bottom plate respectively, and being firmly connected to the floor pallet and attached to it.

Due to the form-fit non-positive fastening of the steel-mesh support shell by means of the extended rods which pass through the pallets, secure fastening of the two components is ensured even for highest stresses involving elastic and partially plastic deformation of the steel-mesh rods. Tear-off of the steel-mesh shell fasteners from the pallet is prevented.

In one of the designs according to the present invention, the steel-mesh rods passed through the top plate and/or bottom plate of the floor pallet are provided with a thread at their bottom ends and firmly attached to the floor pallet from below by means of a washer and nut.

According to another design, the steel-mesh rods passed through the top plate and/or bottom plate of the floor pallet may be permanently welded or brazed to a metal disk on the underside of the floor pallet. This will ensure a simple and absolutely secure fastening of the steel-mesh cage to the floor pallet, which may be, for example, a normal wooded pallet, a plastic pallet, or a metal frame pallet, and provides a stable foundation for the pallet container providing access for a forklift or three-wheel lifting truck from four sides. Another practical design of the invention provides that, in addition to the individual vertical rods passed through and fastened from below, a number of additional extended vertical rods are inserted in corresponding additional bores in the floor pallet, supporting the steel-mesh cage in the radial direction. In this case, the very bottom horizontal rod of the steel-mesh support cage is seated on the top plate and supports the cage on the floor plate in the axial direction. This ensures an absolutely safe fixing of the bottom edge of the cage to the pallet in the radial and axial directions, so that U frames or angle sections for bracing the cage edge may be entirely eliminated.

BRIEF DESCRIPTION OF THE DRAWINGS

Below, the invention is explained and described in more detail by means of the example designs shown in the figures.

In FIG. 1, reference number 10 designates a pallet container mainly comprising an inner, thin-walled plastic container, a steel-mesh cage 14 tightly enclosing the steel-mesh cage 14 and a floor pallet 16. The sectional area of pallet 16, being a plastic pallet in this case, indicates how an extended vertical rod 18 is passed through the pallet 16 and fastened from below.

FIG. 2 shows, in a top view of the pallet container 10, the arrangement of two extended rods 18 each passed through the pallet 16 on each of the outer faces of the floor pallet 16. However, three, four or more extended rods passed through the pallet may also be used for fastening (screwed/welded connection) the steel-mesh cage on each of the outer faces of the floor pallet.

The design of the plastic container, cage and floor pallet according to the present invention ensures that the inner container of the pallet container will be leakproof, even after dropping e.g. from the floor of a truck resulting in partial deformation of the floor pallet and the cage, and can still be picked up and transported by a forklift vehicle without problems.

Figure 1:
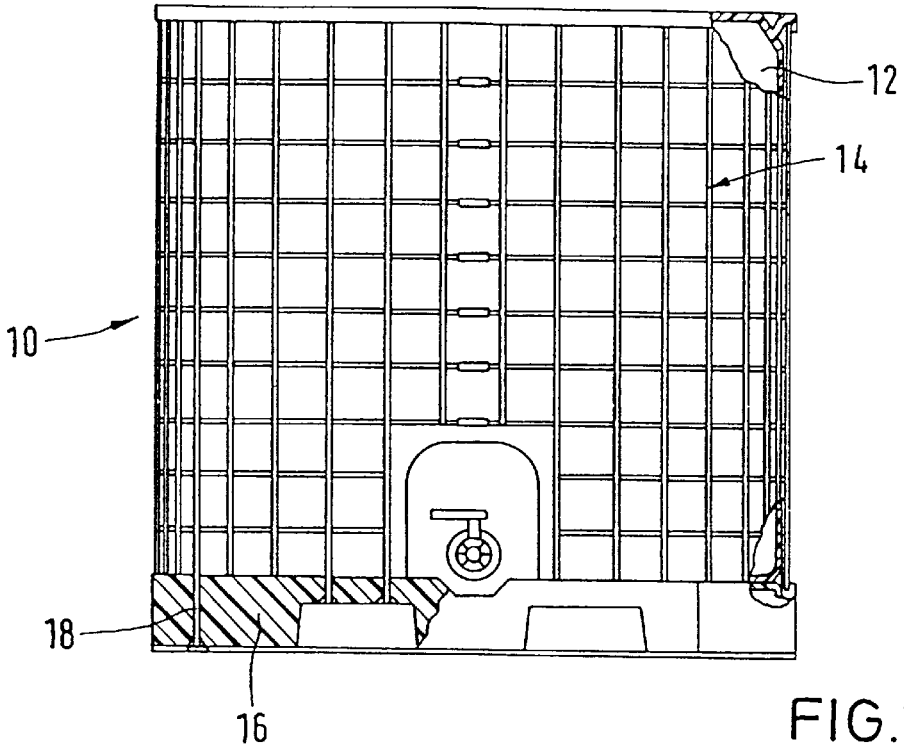
FIG. 1 shows a pallet container according to the invention in a lateral view, partly in sectional representation.
Figure 2:
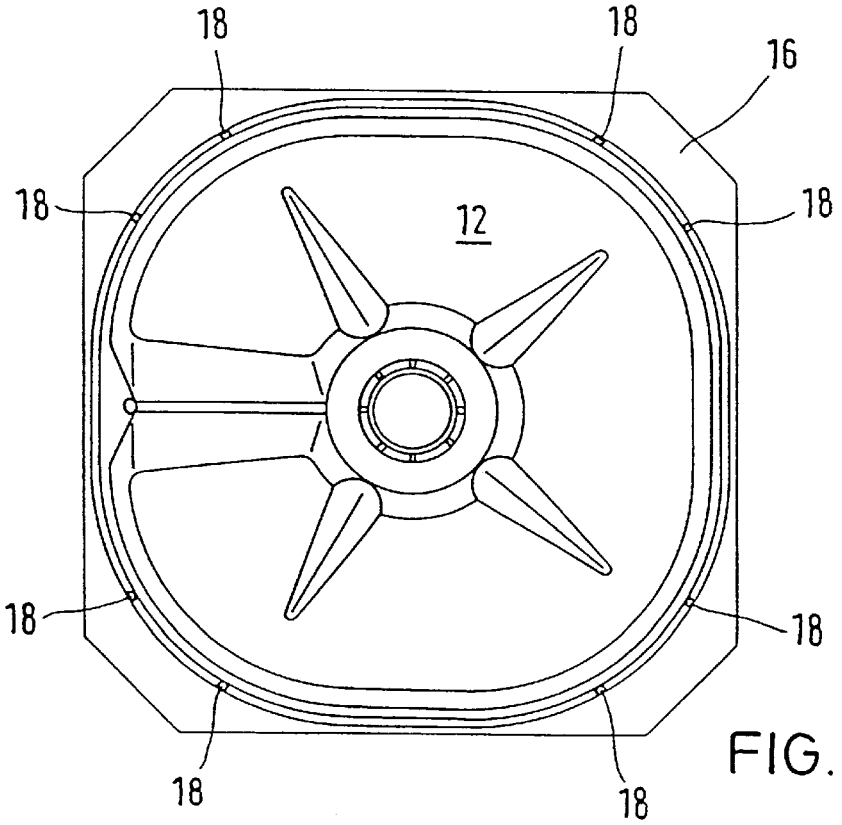
FIG. 2 shows a top view of a pallet container indicating some of the vertical rods passed through the floor pallet.
Figure 3:
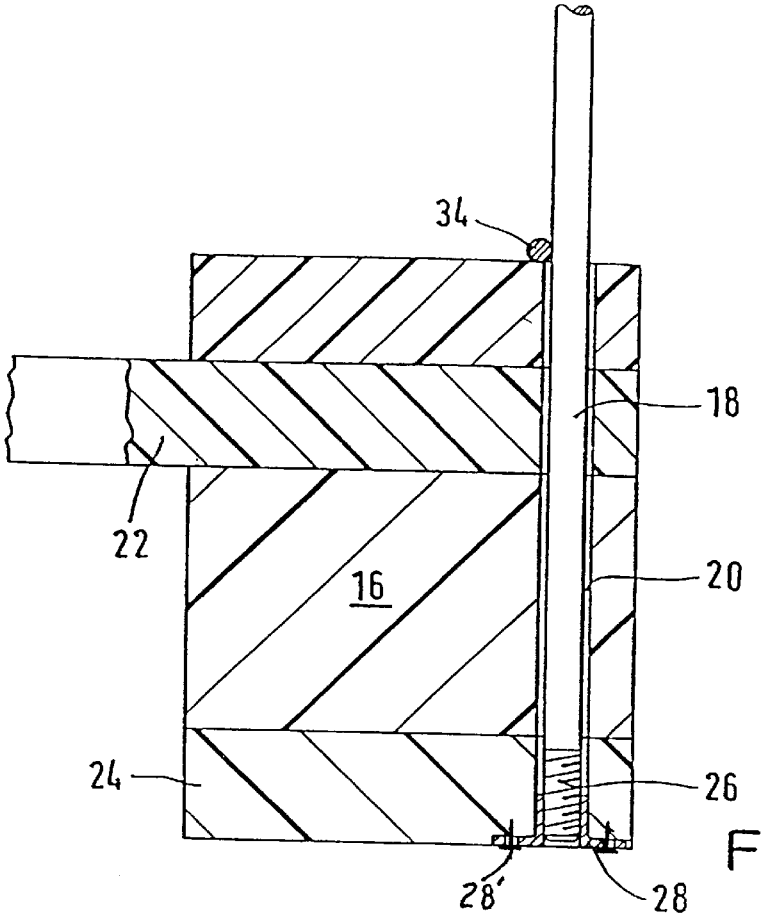
FIG. 3 shows an enlarged sectional representation of the floor pallet.

FIG. 3 shows an extended vertical rod 18 of the steel-mesh reinforcing cage passed through the entire height of the pallet, consisting of the top plate 22 and bottom plate 24, through a bore 20 and fastened from below by means of a nut 28 or a nut/washer combination screwed onto the thread 26.

The nut/washer combination may in addition be fixed by a pin or nail 28 to prevent that it comes loose accidentally.

Figure 4:
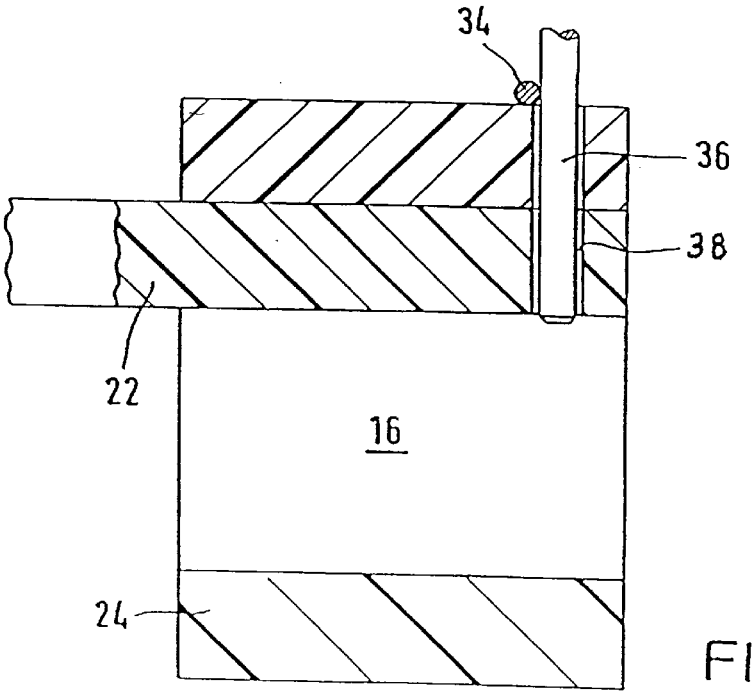
FIGS. 4 to 7 show other sectional representations of the floor pallet.

FIG. 4 indicates that, in addition to the individual vertical rods 18 passed through and fastened from below, a number of additional extended vertical rods 36 are inserted in corresponding additional bores 38 in the floor pallet, supporting the steel-mesh cage 14 in the radial direction. These additional rods only need to be extended so far that they will reach through the top plate 22. Furthermore it is indicated that the very bottom rod of the steel-mesh support cage 14 is seated on the top plate 22 of the pallet 16 and supports the cage 14 on the floor pallet in the axial direction. This makes it possible to eliminate, for example, an additional groove in the pallet surface, or an angle frame installed on the pallet, for the purpose of fixing the bottom steel-mesh edge against radial deformation.

Figure 5:
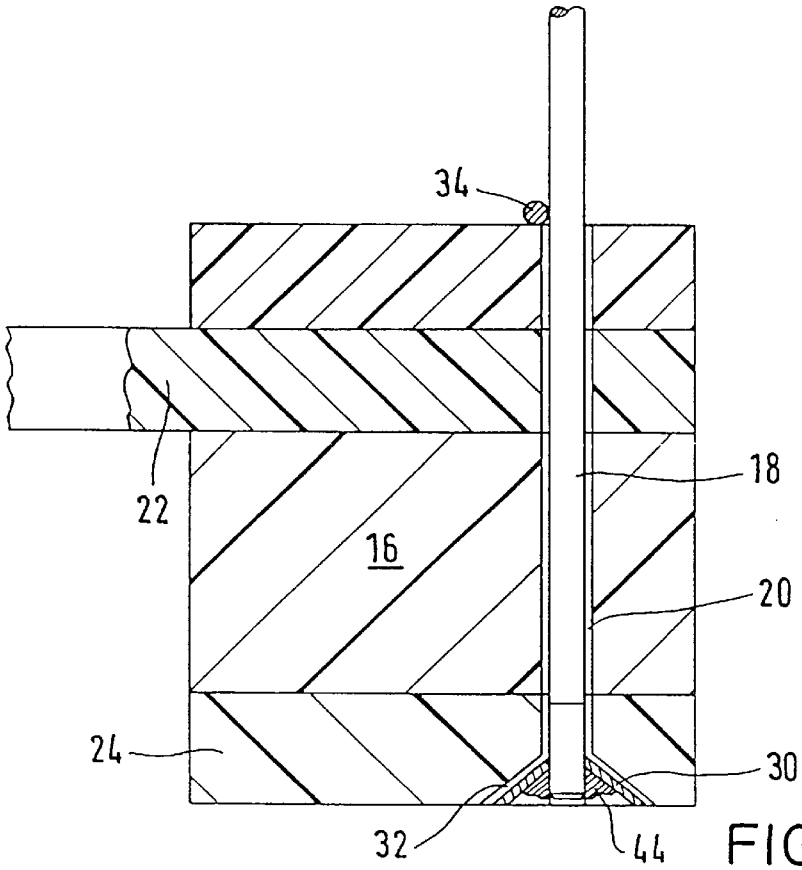

Another possible fastening method of the extended rods 18 to the pallet underside is shown in FIG. 5. The bottom end of the extended rod 18 passed through the pallet 16 is welded or brazed to a hollow-cone metal disk 30. This fastening method saves the machining of treads in the rods and can be realized with time and cost savings. For practical purposes the metal disk 30 is sunk in a recess 32 in the underside of the pallet so that the rod 18 and the metal disk 30 with the weldment 44 are flush with he underside of the pallet.

Figure 6:
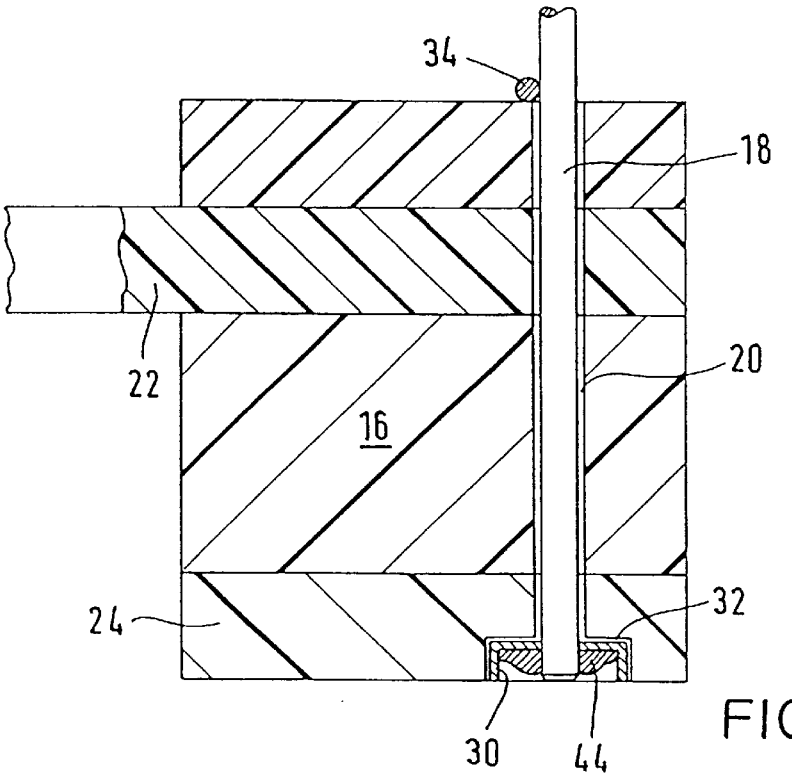

FIG. 6 illustrates a corresponding anchoring configuration with a cylindrically cupped metal disk 30 and a recessed weldment 44, whereby the flush-mount of the disk against the bottom surface of the pallet provides enhanced resistance to tractive forces.

Figure 7:
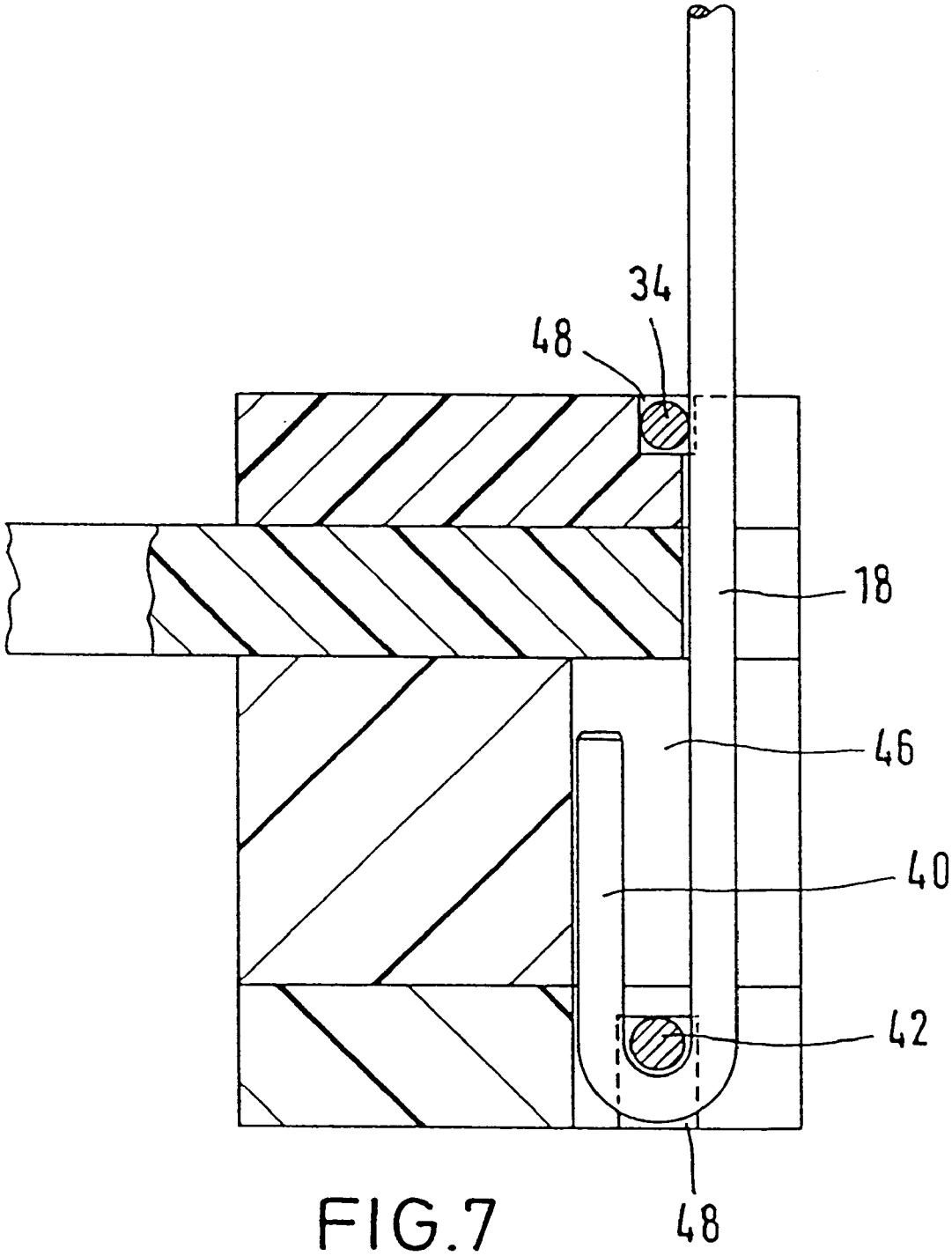

Finally, FIG. 7 shows another of the may possible methods for fastening the extended rods 18 to the pallet underside. With this method, the passed-through extended rods 18 have an eye, a hook 40, or a similar connecting element at their lower ends, and a horizontal locking rod 42 is passed through the hooks 40 to form a heel. The locking bar 42 is sunk in the bottom of the pallet. This variation is very favourable, for example, for simple and fast dismantling of the pallet container into its individual components when such a container is being disposed of. It may be useful to simply insert the extended rods 18 which are provided with hooks 40 in open slots 46, while the very bottom horizontal rod 34 seated on the pallet surface is sunk into a corresponding groove pressed or milled into the pallet surface. In the same manner, corresponding grooves 48 running along the pallet faces are worked into the pallet faces on the underside of the floor pallet 16. The locking bars 42, which are passed through the hooks 40 and can be removed, are sunk in these grooves. A cage that is firmly connected to the floor pallet—whether of wood, plastic or another material—in this manner will be much better able to convert the kinetic energy which occurs in a drop or impact on the ground into elastic, and partially plastic, deformation energy (little deformation of the steel-mesh cage on the impacting edge of the pallet face) without significant damage to the pallet container, so that a dropped pallet container can still be picked up and transported by means of a forklift vehicle, for example.

Naturally, the idea of the present invention—fastening the lower support cage edge to the floor pallet—may also be realized in variations of the pallet container described. For example, instead of a steel-mesh cage, or instead of the thinner steel-mesh rods, metal pipes may be provided for—which may even run only vertically. The preferred pallet is a plastic pallet—preferably of recycled plastic. However, a wood pallet or a metal pallet (sheet steel/metal frame construction) may also be used.

The preferred fastening method for the passed-through rods, by means of removable nuts, is shown in FIG. 3. Fastening the cage and floor pallet in a removable manner facilitates subsequent dismantling of the components after disposing of a used pallet container (recycling).

We claim:

1. In a pallet container (10) comprised of a thin-walled plastic container (12) for liquid or flowable substances, a steel-mesh support cage (14) of horizontal and vertical rods welded together and tightly enclosing the plastic container (12), and a floor pallet (16), including at least one plate having a bottom side and an opposite top side, on which the plastic container (12) is seated and to which the steel-mesh support cage is attached, the improvement wherein:

a) the pallet includes at least one bore (20) extending into said at least one plate from the top side thereof; and b) one vertical rod (18) of said vertical rods of the steel-mesh support cage (14) extends into each bore (20) from the top side of said at least one plate and is connected to said floor pallet against relative movement with respect thereto.

2. A pallet container according to claim 1 wherein:

a) the vertical rods (18) passing through said at least one plate of the floor pallet (16) each includes a thread (26) at a lower end thereof; and b) a threaded nut (28), having a threaded bore extending along a predetermined axis, is threaded onto said lower end from the bottom side of said plate to connect said rod to said floor pallet.

3. A pallet container according to claim 1 wherein:

a) each of the rods (18) passing through said at least one plate of the floor pallet (16) are firmly welded or brazed to a metal disc (30) disposed on the bottom side of said plate of the floor pallet (16).

4. A pallet container according to claim 3 wherein:

a) the welded metal disc (30) has a hollow cone or hollow cylinder shape and is sunk in a corresponding recess (32) of the bottom side of the at least one plate of the floor pallet (16) to which the rods are connected.

5. A pallet container according to claim 1 wherein:

a) each of said vertical rods (18) has a joining element comprising an eye, a hook (40) or a similar shape to define said joining element at a lower end of the rod; and b) a horizontal locking bar (42) extends through said joining element and said at least one plate to connect said rod to said plate.

6. A pallet container according to any one of claims 1–5 wherein:

a) said floor pallet (16) includes a top plate (22) and a bottom plate (24) spaced below said top plate;

b) each bore extends through said top and bottom plates;

c) one of said rods extends through each of said bores; and d) each one of said rods is connected to said bottom plate (24).

7. A pallet container according to claim 6 wherein:

a) said vertical rods (18) of said steel-mesh support cage (14) are disposed in encircling relation to said container (12); and b) a plurality of said encircling vertical rods (18) extend into said bore means (20) and are connected to said bottom plate (24).

8. A pallet container according to any one of claims 1–4 wherein:

a) in addition to said vertical rods (18), multiple additional rods (36) are connected to the floor pallet (16) through corresponding additional bores (38) and support the cage (14) against movement in a direction laterally of said pallet.

9. A pallet container according to any one of claims 1–4 wherein:

a) each of said rods (18) of the support cage are hollow tubes; and b) the floor pallet (16) is a thermoplastic plastic pallet.

10. In a pallet container (10) comprised of a thin-walled plastic container (12) for liquid or flowable substances, a steel-mesh support cage (14) of horizontal and vertical rods welded together and tightly enclosing the plastic container (12), and a floor pallet (16), including at least one plate having a bottom side and an opposite top side, on which the plastic container (12) is seated and to which the steel-mesh support cage is attached, the improvement wherein:

a) a horizontal rod (34) at the bottom of the steel-mesh support cage (14) rests on said at least one plate for supporting the cage (14) on the floor pallet (16) against movement in a direction perpendicular to said pallet;

b) the pallet includes at least one bore (20) extending into said at least one plate from the top side thereof; and c) one vertical rod (18) of said vertical rods of the steel-mesh support cage (14) extends downwardly beyond said horizontal rod (34) and into each bore (20) from the top side of said at least one plate and is connected to said floor pallet against relative movement with respect thereto.

11. In a pallet container (10) comprised of a thin-walled plastic container (12) for liquid or flowable substances, a steel-mesh support cage (14) of horizontal and vertical rods tightly enclosing the plastic container (12), and a floor pallet (16), including at least one plate having a bottom side and an opposite top side, on which the plastic container (12) is seated and to which the steel-mesh support cage is attached, the improvement wherein:

a) the pallet includes at least one bore (20) extending into said at least one plate from the top side thereof;

b) one vertical rod (18) of said vertical rods of the steel-mesh support cage (14) extends into each bore (20) from the top side of said at least one plate and is connected to said floor pallet against relative movement with respect thereto; and c) the vertical rods (18) passing through said at least one plate of the floor pallet (16) each includes a thread (26) at a lower end thereof;

d) a threaded nut (28), having a threaded bore extending along a predetermined axis, is threaded onto said lower end from the bottom side of said plate to connect said rod to said floor pallet; and e) the threaded nut has a lower end facing away from said floor pallet and is threaded onto the lower end of said rod to a position where its lower end is flush with the bottom of said floor pallet whereby said bottom and lower end together define a smooth surface.

12. A pallet container according to claim 11 wherein:

a) said threaded nut is removably threaded onto said rod.

13. A pallet container according to claim 11 wherein:

a) the threaded nut includes a washer portion formed integrally therewith and extending in a radially outward direction relative to said predetermined axis.

14. A pallet container according to claim 13 wherein:

a) said washer portion defines said lower end of said threaded nut.

15. A pallet container according to claim 14 further including:

a) securing means for fixing said washer portion against rotation to said bottom of said floor pallet.

16. A pallet container according to claim 15 wherein:

a) said securing means is at least one nail passing through said washer portion and into said plate.

* * * * *